US010320100B2

(12) United States Patent
Phillips

(10) Patent No.: US 10,320,100 B2
(45) Date of Patent: Jun. 11, 2019

(54) CARD EDGE CONNECTOR ASSEMBLY

(71) Applicant: TE CONNECTIVITY CORPORATION, Berwyn, PA (US)

(72) Inventor: Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/726,473

(22) Filed: Oct. 6, 2017

(65) Prior Publication Data

US 2019/0109392 A1 Apr. 11, 2019

(51) Int. Cl.

| | |
|---|---|
| ***H01R 13/627*** | (2006.01) |
| ***H01R 12/70*** | (2011.01) |
| ***H01R 12/73*** | (2011.01) |
| ***H01R 12/72*** | (2011.01) |

(52) U.S. Cl.

CPC ..... *H01R 12/7005* (2013.01); *H01R 12/721* (2013.01); *H01R 12/737* (2013.01); *H01R 13/6278* (2013.01)

(58) Field of Classification Search

CPC ..... H01R 12/7005; H05K 7/1405

USPC ..... 439/325, 327, 328, 377, 347; 361/756, 361/801

See application file for complete search history.

(56) References Cited

U.S. PATENT DOCUMENTS 3,216,580 A * 11/1965 Fricker, Jr. ..... H05K 7/1417 211/41.17
3,823,367 A * 7/1974 Kaye ..... G01R 31/362 320/114
3,829,741 A * 8/1974 Athey ..... H05K 3/366 174/138 D
3,842,395 A * 10/1974 Tucker ..... H01R 13/26 439/347
4,146,682 A * 3/1979 Nakao ..... H01M 2/1055 292/175
4,198,024 A * 4/1980 Cavanna ..... H05K 7/1405 211/41.17
4,386,243 A * 5/1983 De Luca ..... H04M 3/30 379/19
4,575,595 A * 3/1986 Gill ..... H01H 9/20 200/50.3
4,774,399 A * 9/1988 Fujita ..... G06K 7/0047 235/441
4,843,477 A * 6/1989 Mizutani ..... B60R 11/0235 312/7.2
5,033,972 A * 7/1991 Komatsu ..... G06K 7/0047 439/153

(Continued)

*Primary Examiner* — Neil Abrams

(57) ABSTRACT

A card edge connector assembly includes a card edge connector having a housing defining a card slot receiving a pluggable module and a card guide module coupled to the housing. The card guide module has a main body having a cavity receiving the pluggable module and support beams secured to the host circuit board with a window defined between the support beams under the main body receiving the card edge connector. A latch is coupled to the main body being latchably coupled to the pluggable module in a latched position to secure the pluggable module in the cavity and being decoupled from the pluggable module in an unlatched position to allow the pluggable module to be removed from the cavity. An actuator with a ramp surface may be pressed downwardly to drive the latch to the unlatched position.

20 Claims, 4 Drawing Sheets

(56) References Cited

U.S. PATENT DOCUMENTS 5,066,241 A * 11/1991 Hills ..... G06K 7/0047 439/260
5,155,663 A * 10/1992 Harase ..... G06K 19/07732 273/148 B
5,208,116 A * 5/1993 Joh ..... G06F 1/1616 429/100
5,225,293 A * 7/1993 Mitchell ..... G06F 1/1613 429/97
5,227,953 A * 7/1993 Lindberg ..... G06F 1/1632 361/679.41
5,305,180 A * 4/1994 Mitchell ..... G06F 1/1616 361/679.37
5,611,513 A * 3/1997 Rosen ..... F16M 11/10 248/222.11
5,650,917 A * 7/1997 Hsu ..... H05K 7/1407 361/727
5,711,558 A * 1/1998 Woody ..... B60L 11/1818 292/144
5,716,730 A * 2/1998 Deguchi ..... H01M 2/1022 429/123
5,777,316 A * 7/1998 Horie ..... G06K 19/077 235/486
5,822,193 A * 10/1998 Summers ..... H05K 7/1408 361/759
5,844,401 A * 12/1998 Lee ..... H02J 7/0042 320/107
5,903,132 A * 5/1999 Ohira ..... H04M 1/0262 320/107
5,943,218 A * 8/1999 Liu ..... H05K 7/1405 361/679.32
5,980,295 A * 11/1999 Lai ..... H05K 7/1405 439/327
6,027,358 A * 2/2000 Lai ..... H01R 12/88 439/327
6,126,471 A * 10/2000 Yu ..... H05K 7/1405 439/327
6,152,754 A * 11/2000 Gerhardt ..... H01R 13/5224 439/325
6,175,491 B1 * 1/2001 Park ..... G06F 1/183 361/679.57
6,216,195 B1 * 4/2001 Lee ..... G06F 1/1632 361/679.41
6,219,251 B1 * 4/2001 Wang ..... H05K 7/1431 361/704
6,259,600 B1 * 7/2001 Talbot ..... G06F 1/20 361/679.47
6,312,279 B1 * 11/2001 Rachui ..... H01R 12/89 439/327
6,356,053 B1 * 3/2002 Sandoz ..... H02J 7/0044 320/115
6,398,567 B1 * 6/2002 Nishimura ..... G06K 13/08 439/159
6,402,565 B1 * 6/2002 Pooley ..... H01R 9/0515 439/347
6,438,229 B1 * 8/2002 Overy ..... H02J 7/0044 379/446
6,469,900 B2 * 10/2002 Cheng ..... G06F 1/1616 248/551
6,757,172 B2 * 6/2004 Maruyama ..... G06K 7/00 361/726
6,767,230 B2 * 7/2004 Lai ..... H01R 12/7029 439/153
6,942,514 B1 * 9/2005 Cheng ..... H01R 12/7029 439/328
7,364,452 B2 * 4/2008 Carver ..... H01R 43/26 439/310
7,381,075 B2 * 6/2008 Gontarek ..... B60R 11/0241 361/679.41
7,887,942 B2 * 2/2011 Rejman ..... H01M 2/1022 429/100
8,056,813 B2 * 11/2011 Long ..... G06K 13/08 235/486
8,360,485 B2 * 1/2013 Ma ..... H05K 5/0221 292/137
8,371,870 B2 * 2/2013 Ma ..... G06F 3/038 345/163
8,498,123 B2 * 7/2013 Kawada ..... G06F 1/1635 360/99.02
9,065,210 B2 * 6/2015 Narita ..... H01R 13/629
9,093,789 B2 * 7/2015 Aoki ..... H01R 13/641
9,260,080 B2 * 2/2016 Maguire ..... B60R 25/40
2010/0228405 A1 * 9/2010 Morgal ..... B62H 3/02 701/2

* cited by examiner

CARD EDGE CONNECTOR ASSEMBLY

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge, such as a circuit card of a pluggable module. However, know card edge connectors are not without disadvantages. For instance, the card edge connectors are typically designed for supporting the pluggable modules. The card edge connectors are subjected to stresses and strains during mating or when mated with the pluggable modules, which may damage or break the soldered connections between the contacts of the card edge connector and the host circuit board. Additionally, retention of the pluggable modules in the card edge connectors may present problems. For instance, latching systems are designed and occupy space around the card edge connectors for retaining the pluggable module in the card edge connector, limiting placement of other components on the host circuit board.

A need remains for a card edge connector assembly that may be mated with pluggable modules in a reliable manner.

BRIEF DESCRIPTION OF THE INVENTION

In one embodiment, a card edge connector assembly is provided including a card edge connector having a housing defining a card slot configured to receive a pluggable module in a mating direction. The housing holds contacts in the card slot to electrically connect to the pluggable module that are configured to be electrically connected to a host circuit board. The card edge connector assembly includes a card guide module having a main body having a cavity configured to receive the pluggable module. The card guide module has support beams extending from the main body configured to be secured to the host circuit board. The card guide module has a window defined between the support beams under the main body receiving the card edge connector. A latch is coupled to the main body movable between a latched position and an unlatched position. The latch is latchably coupled to the pluggable module in the latched position to secure the pluggable module in the cavity and is decoupled from the pluggable module in the unlatched position to allow the pluggable module to be removed from the cavity.

In another embodiment, a card edge connector assembly is provided including a card guide module having a main body including a first side and a second side, a first end and a second end between the first side and the second side with the first and second sides being wider than the first and second ends, and a top and a bottom between the first and second sides and between the first and second ends. The main body has a cavity open at the top and at the bottom for receiving a pluggable module. The card guide module has support beams extending from the main body at the first and second ends configured to be secured to a host circuit board proximate to a card edge connector. The card guide module has a window defined between the support beams below the bottom of the main body receiving the card edge connector with the card edge connector aligned with the cavity to receive the pluggable module. A latch is coupled to the first side of the main body being movable between a latched position and an unlatched position. The latch is configured to be latchably coupled to the pluggable module in the latched position to secure the pluggable module in the cavity. The latch is configured to be decoupled from the pluggable module in the unlatched position to allow the pluggable module to be removed from the cavity.

In a further embodiment, a card edge connector assembly is provided including a card guide module having a main body including a first side and a second side, a first end and a second end between the first side and the second side, and a top and a bottom between the first and second sides and between the first and second ends. The main body has a cavity open at the top and at the bottom for receiving a pluggable module. The card guide module has support beams extending from the main body at the first and second ends configured to be secured to a host circuit board proximate to a card edge connector. The card guide module has a window defined between the support beams below the bottom of the main body receiving the card edge connector with the card edge connector aligned with the cavity to receive the pluggable module. The card guide module includes a latch frame extending from the first side having a latch pocket. A latch is receiving in the latch pocket of the latch frame at the first side of the main body. The latch has a latching member being movable between a latched position and an unlatched position and an actuator being movable between an actuated position and a released position. The actuator moves the latching member from the latched position to the unlatched position as the actuator is moved from the released position to the actuated position. The latching member has a latching finger passing through the first side of the main body into the cavity to latchably engage the pluggable module in the latched position to secure the pluggable module in the cavity. The latching finger is at least partially removed from the cavity to disengage from the pluggable module in the unlatched position to allow the pluggable module to be removed from the cavity.

DETAILED DESCRIPTION OF THE INVENTION

Figure 1:
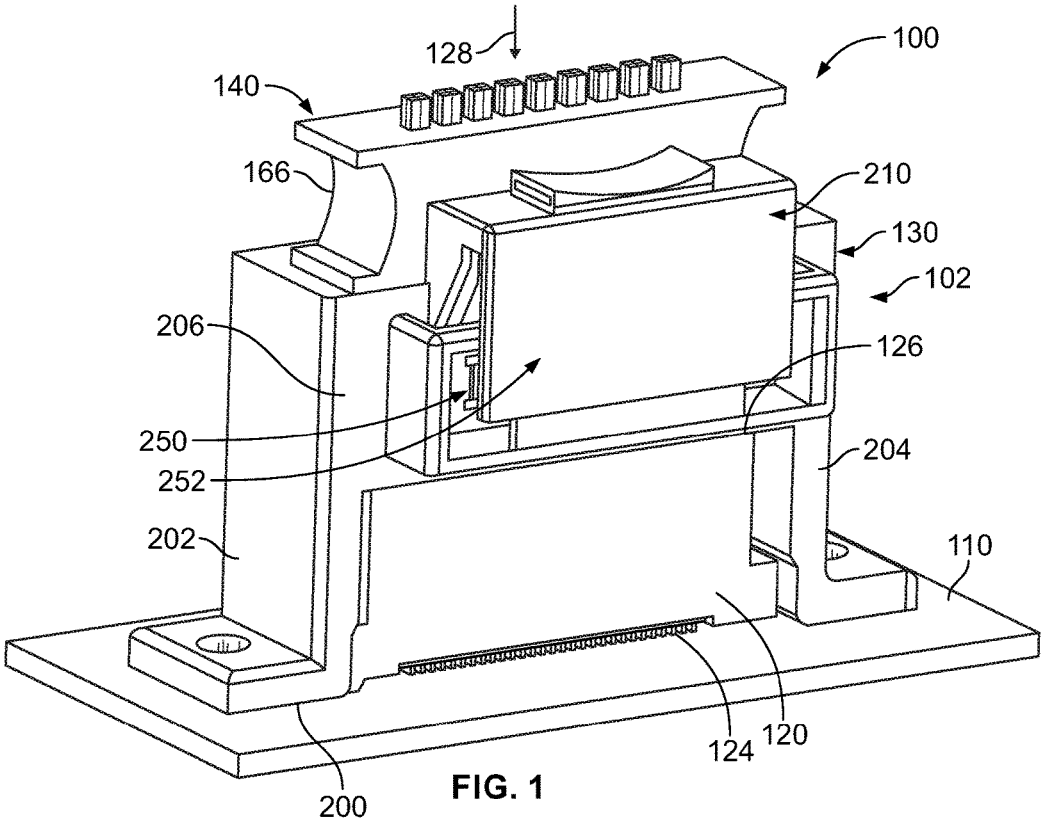
FIG. 1 is a perspective view of an electrical system having a card edge connector assembly in accordance with an exemplary embodiment showing the card edge connector assembly in a mated position.

FIG. 1 is a perspective view of an electrical system 100 having a card edge connector assembly 102 in accordance with an exemplary embodiment showing the card edge connector assembly 102 in a mated position. The card edge connector assembly 102 is mounted to a host circuit board 110. In the illustrated embodiment, the card edge connector assembly 102 is a vertical card edge connector assembly where the components are oriented and mated generally vertically or perpendicular to the host circuit board 110. However, in other various embodiments, the electrical system 100 may have components in different orientations, such as at a right angle orientation. Other types of card edge connector assemblies may be utilized in alternative embodiments.

The card edge connector assembly 102 includes a card edge connector 120 and a card guide module 130 mounted over the card edge connector 120. The card edge connector assembly 102 includes a pluggable module 140 mated with the card edge connector 120 and the card guide module 130. The card edge connector 120 is configured to be mounted to the host circuit board 110, such as by soldering contacts 124 of the card edge connector 120 to the host circuit board 110; however, the contacts 124 may be attached by other processes such as press fit contacts, spring beam contacts, and the like. The card edge connector 120 has a mating end 126 configured to receive a mating end or card edge of the pluggable module 140. In the illustrated embodiment, the mating end 126 is provided at a top of the card edge connector 120 to receive the pluggable module 140 in a generally vertical mating direction 128, such as a mating direction perpendicular to the host circuit board 110.

In various embodiments, the card guide module 130 includes a base 200 mounted to the host circuit board 110 independent of the card edge connector 120 such that the card guide module 130 is self-supporting or otherwise not supported by the card edge connector 120. In an exemplary embodiment, the card guide module 130 includes support members for supporting the card guide module 130 and the pluggable module 140, such as first and second support beams 202, 204 at opposite ends of the card edge connector 120. The card guide module 130 alleviates stress or strain on the card edge connector 120 from the pluggable module 140, such as from movement of the pluggable module 140. The support beams 202, 204 transfer stresses or strains from the pluggable module 140 into the base 200, and thus into the host circuit board 110, separate from the card edge connector 120, to alleviate stress or strain on the card edge connector 120.

In an exemplary embodiment, the card guide module 130 includes a main body 206 between the support beams 202, 204. The main body 206 is located above the card edge connector 120, such that the main body 206 and the support beams 202, 204 surround the card edge connector 120. In the illustrated embodiment, the main body 206 connects the support beams 202, 204 such that the card guide module 130 is a single, unitary structure. The main body 206 receives the pluggable module 140 and may guide mating of the pluggable module 140 with the card edge connector 120.

In an exemplary embodiment, the card guide module 130 includes a latch 210 for latchably securing the pluggable module 140 in the card guide module 130 and the card edge connector 120. In the illustrated embodiment, the latch 210 includes a latching member 250 being movable between a latched position and an unlatched position and an actuator 252 being movable between an actuated position and a released position. The latch 210 is releasably coupled to the pluggable module 140 using the latching member 250. The latch 210 is configured to be unlatched to release the pluggable module 140 from the card edge connector 140 and the card guide module 130. For example, the actuator 252 may include a push button configured to be pressed downward to unlatch the latching member 250; however, other types of actuators may be provided in alternative embodiments, such as a pull tab, a tether, a hinged latch, and the like.

Figure 2:
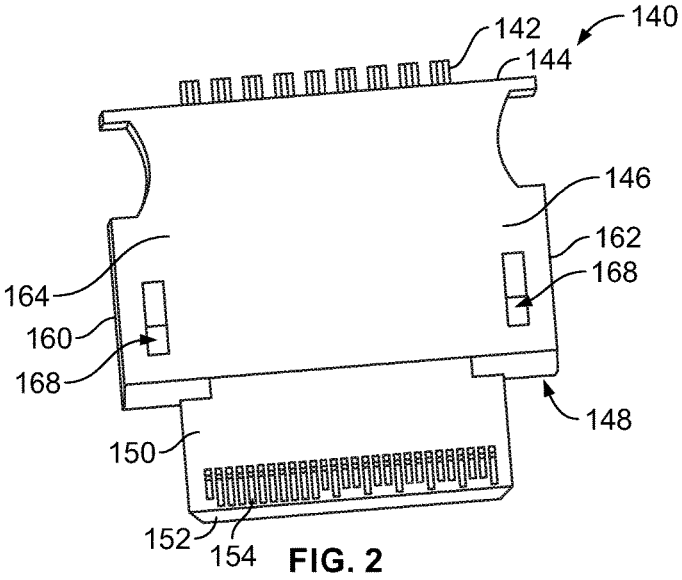
FIG. 2 is a perspective view of a pluggable module of the card edge connector assembly in accordance with an exemplary embodiment.

FIG. 2 is a perspective view of the pluggable module 140 in accordance with an exemplary embodiment. In the illustrated embodiment, the pluggable module is a cabled pluggable module having cables 142 extending from a cable end 144 of the pluggable module 140; however, other types of pluggable modules may be utilized in alternative embodiments, such as non-cabled pluggable modules. The pluggable module 140 includes a body 146 holding a substrate 150, such as a circuit card, at a mating end 148 of the pluggable module 140. The substrate 150 may extend below the body 146 a distance for loading into the card edge connector 120 (shown in FIG. 1). The cables 142 are terminated to the substrate 150, such as by soldering to the substrate 150. Optionally, the body 146 may be overmolded over the substrate 150 and the cables 142.

The substrate 150 has a card edge 152 at the mating end 148 configured to be loaded into the card edge connector 120. The pluggable module 140 has a plurality of contact pads 154 at the card edge 152 configured to be electrically connected to the card edge connector 120. Optionally, the pluggable module 140 may include one or more electrical components (not shown) on the substrate 150, such as a memory, a processor, or other types of electrical components. The electrical components are electrically connected to corresponding contact pads 154. The pluggable module 140 includes various circuits transmitting data and/or power between the contact pads 154, the electrical components, and the cables 142. The pluggable module 140 may include one or more heat sinks for dissipating heat from the pluggable module 140.

The pluggable module 140 extends between a first end 160 and a second end 162. The pluggable module 140 has a first side 164 and a second side 166 (shown in FIG. 1) between the first and second ends 160, 162. The sides 164, 166 are wider than the ends 160, 162. The pluggable module 140 includes latching features 168 at the first and second sides 164, 166 for securing the pluggable module 140 in the card edge connector assembly 102. In the illustrated embodiment, the latching features 168 are pockets or openings formed in the first and second sides 164, 166. Other types of latching features may be provided in alternative embodiments. In the illustrated embodiment, the latching features 168 are formed in the body 146, however, the latching features 168 are also be formed in the substrate 150.

Figure 3:
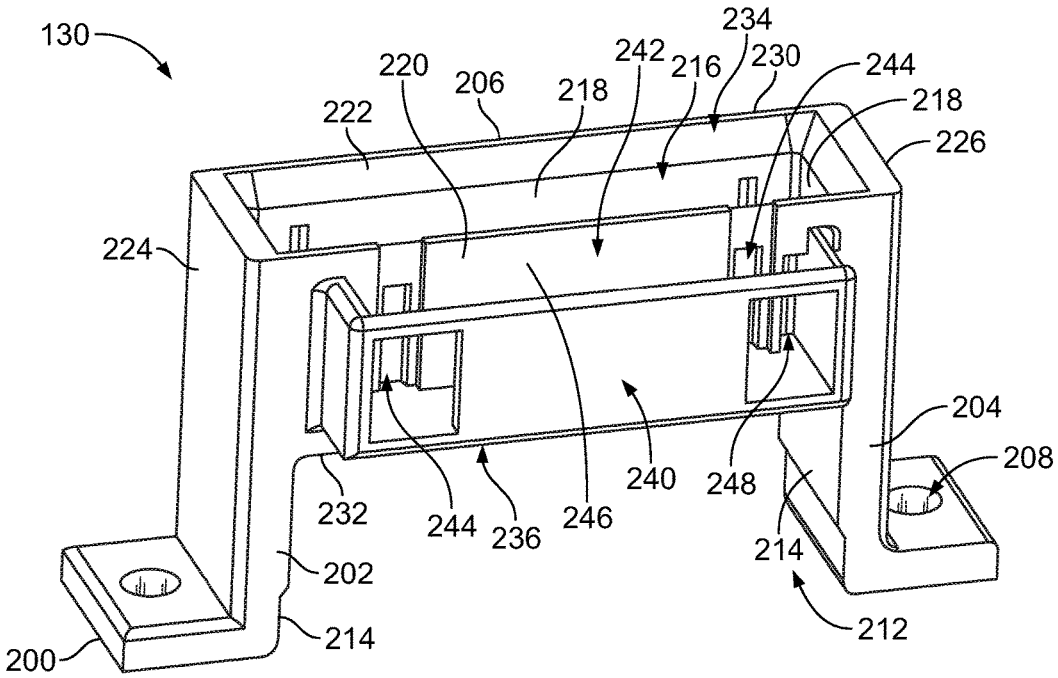
FIG. 3 is a perspective view of a card guide module of the card edge connector assembly in accordance with an exemplary embodiment.

FIG. 3 is a perspective view of the card guide module 130 in accordance with an exemplary embodiment. The card guide module 130 includes the main body 206 and the support beams 202, 204 extending from the main body 206 to the base 200. Optionally, the support beams 202, 204 may be wider at the base 200 to provide stability to the support beams 202, 204 for mounting to the host circuit board 110. In an exemplary embodiment, the support beams 202, 204 each include a mounting feature 208 at the base 200 for mounting the base 200 to the host circuit board 110. In the illustrated embodiment, the mounting features 208 are openings configured to receive mounting hardware, such as fasteners. Other types of mounting features may be provided in alternative embodiments, such as a threaded opening, a post, a barb, a solder feature, and the like.

The support beams 202, 204 include inner ends defining a window 212 configured to receive the card edge connector 120. The inner ends face the card edge connector 120 and may engage the card edge connector 120 to locate the card guide module 130 relative to the card edge connector 120. The inner ends define locating surfaces 214 for locating the card guide module 130 relative to the card edge connector 120. The locating surfaces 214 may include vertical surfaces, angled surfaces and/or shoulder surfaces for engaging and locating various complementary surfaces of the card edge connector 120.

The main body 206 includes a cavity 216 configured to receive the pluggable module 140. The cavity 216 is located above the window 212 to allow the pluggable module 140 to pass through the cavity 216 into the card edge connector 120 in the window 212. In an exemplary embodiment, the main body 206 includes lead-in surfaces at the top of the cavity 216 to guide the pluggable module 140 into the cavity 216 during mating. In an exemplary embodiment, the main body 206 includes at least one guide surface 218 in the cavity 216 to guide and locate the pluggable module 140 in the cavity 216. The guide surface 218 may control a side-to-side or end-to-end position of the pluggable module 140 relative to the card guide module 130 for positioning the pluggable module 140 relative to the card edge connector 120.

The main body 206 includes a plurality of walls defining a first side 220, a second side 222, a first end 224 and a second end 226. The first and second ends 224, 226 extend between the first side 220 and the second side 222. In an exemplary embodiment, the first and second sides 220, 222 are wider than the first and second ends 224, 226. The first and second sides 220, 222 and the first and second ends 224, 226 define the cavity 216. The main body 206 includes a top 230 and a bottom 232 between the first and second sides 220, 222 and between the first and second ends 224, 226. The bottom 232 defines a portion of the window 212. For example, the main body 206 is located above the window 212. In an exemplary embodiment, the cavity 216 is open at the top 230 and the bottom 232. For example, the main body 206 includes a top opening 234 and a bottom opening 236. The pluggable module 130 is configured to be loaded into the card guide module 130 through the top opening 234. In an exemplary embodiment, the substrate 150 (shown in FIG. 2) is configured to pass through the cavity 216 into the window 212 through the bottom opening 236. The main body 206 may have other shapes in alternative embodiments, such as including additional walls.

In an exemplary embodiment, the card guide module 130 includes a latch frame 240 extending from the first side 220. The latch frame 240 has a latch pocket 242 configured to receive the latch 210. The latch frame 240 holds the latch 210 to one side of the card guide module 130 and the pluggable module 140. In an exemplary embodiment, the latch frame 240 is integral with the main body 206. For example, the latch frame 240 and the main body 206 may be co-molded during a molding process. In an exemplary embodiment, the latch frame 240 is open at a top of the latch frame 240 to receive a portion of the latch 210.

In an exemplary embodiment, the main body 206 includes one or more tracks 244 for receiving a portion of the latch 210. The track 244 may guide actuation of the latch 210 when the latch 210 is operated to release the pluggable module 140 from the card guide module 130. In the illustrated embodiment, the tracks 244 are formed in the wall 246 at the first side 220. Optionally, the tracks 244 may extend vertically to limit actuation of the latch 210 in a vertical direction.

In an exemplary embodiment, the main body 206 includes one or more slots 248 for receiving a portion of latch 210. In the illustrated embodiment, the slots 248 are formed in the wall 246 at the first side 220. The slots 248 provide access to the cavity 216 from the latch pocket 242. The latch 210 is able to extend from the latch pocket 242 into the cavity 216 through the slots 248 to latch of the coupled to the pluggable module 140.

Figure 4:
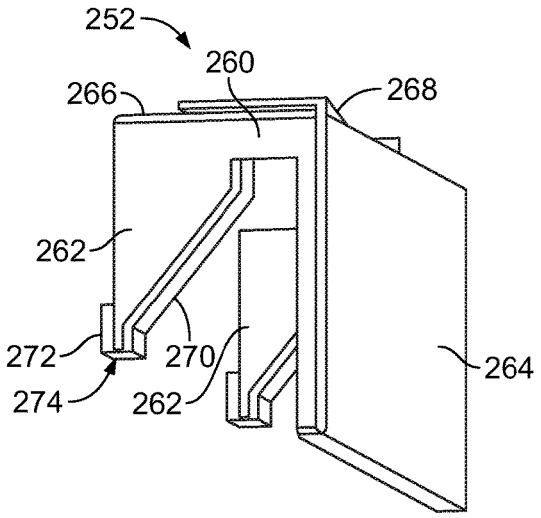
FIG. 4 is a perspective view of a portion of a latch of the card edge connector assembly in accordance with an exemplary embodiment.

FIG. 4 is a perspective view of the actuator 252 in accordance with an exemplary embodiment. The actuator 252 includes a main body 260 having an actuator arms 262 extending from the main body 260. The actuator 252 includes an outer wall 264 extending from the main body 260. In the illustrated embodiment, the outer wall 264 is provided at a front of the actuator 252 and the actuator arms 262 are provided at a rear of the actuator 252. In an exemplary embodiment, the main body 260 is provided at a top 266 of the actuator 252. The actuator 252 includes a press button 268 at the top 266 configured to be engaged and operated by the operator. For example, the operator may press downward on the press button 268 to actuate the actuator 252.

In the illustrated embodiment, the actuator 252 includes a pair of actuator arms 262 provided at opposite ends of the actuator 252. Any number of actuator arms 262 may be provided in alternative embodiments. Each actuator arm 262 includes a ramp surface 270 configured to engage the latching member 250 (shown in FIG. 5) to release the latching member 250 to the unlatched position. In the illustrated embodiment, the ramp surface 270 is angled such that the ramp surface 270 is forward and downward facing. Optionally, the ramp surface 270 may be angled at approximately 45°; however, the ramp surface 270 may be at any appropriate angle for engaging and actuating the latching member 250.

In an exemplary embodiment, each actuator arm 262 includes a rail 272 at the rear of the actuator arm 262. The rail 272 is configured to be received in a corresponding track 244 (shown in FIG. 3) of the card guide module 130 (shown in FIG. 3). The rails 272 may have channels 274 that are configured to receive the track 244 to couple the actuator 252 to the card guide module 130. The rails 272 are configured to ride in the tracks 244 to control movement of the actuator 252 relative to the card guide module 130. In the illustrated embodiment, the rails 272 are provided proximate to the bottoms of the actuator arms 262; however, other locations are possible in alternative embodiments.

Figure 5:
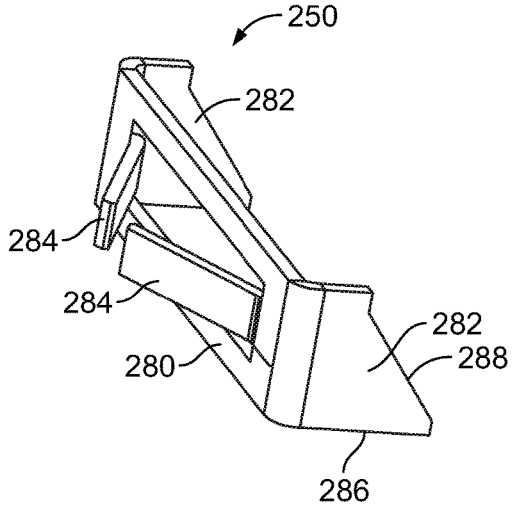
FIG. 5 is a perspective view of a portion of the latch of the card edge connector assembly in accordance with an exemplary embodiment.

FIG. 5 is a perspective view of the latching member 250 in accordance with an exemplary embodiment. The latching member 250 includes a front plate 280 and one or more latching fingers 282 extending from the front plate 280. Optionally, the latching fingers 282 may extend rearward from the front plate 280 at the opposite ends of the front plate 280. While the latching member 250 is illustrated having a pair of latching fingers 282, any number of latching fingers 282 may be provided in alternative embodiments. In an exemplary embodiment, the latching member 250 includes return springs 284 extending from the front plate 280. Optionally, the return springs 284 extend forward from the front plate 280. The return springs 284 are configured to engage the card guide module 130 (shown in FIG. 3) to bias the latching member 250 in a rearward direction and return to the latching member 250 to a latched position. In an exemplary embodiment, the latching member 250 is stamped and formed from a metal sheet of material. For example, the return springs 284 are stamped from the front plate 280 and bent forward while the latching fingers 282 are stamped at the ends of the front plate 280 and bent rearward. The latching member 250 may be formed by other processes in alternative embodiments.

In an exemplary embodiment, the latching fingers 282 include latching surfaces 286 at the bottoms of the latching fingers 282. The latching surfaces 286 are configured to engage the pluggable module 140 (shown in FIG. 2) to secure the pluggable module 140 in the card guide module 130. The latching surfaces 286 are configured to block removal of the pluggable module 140 from the card guide module 130. In an exemplary embodiment, the latching fingers 282 include ramp surfaces 288. Optionally, the ramp surfaces 288 may be generally upward facing and rearward facing. The ramp surfaces 288 are configured to engage the pluggable module 140 when the pluggable module 140 is being loaded into the card guide module 130. The pluggable module 140 may force the latching member 250 to move forward to the unlatched position as the pluggable module 140 is loaded into the card guide module 130 by pressing downward on the ramp surfaces 288, thus driving the latching member 250 out of the way of the pluggable module 140. Optionally, the ramp surfaces 288 may be angled at approximately 45°; however, the ramp surfaces 288 may be at any appropriate angle for engaging the pluggable module 140 and driving the latching member 250 to the unlatched position.

Figure 6:
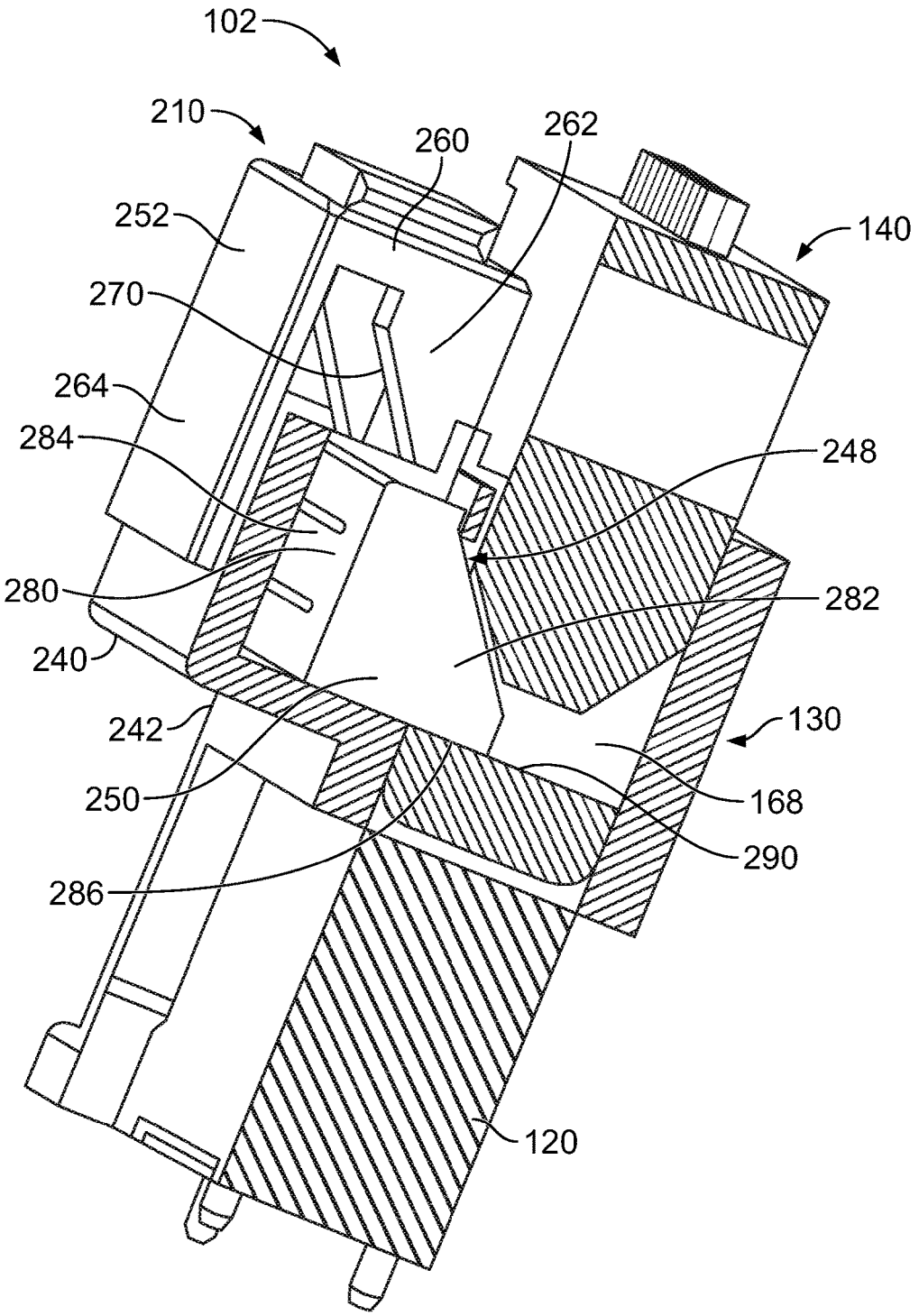
FIG. 6 is a sectional view of the card edge connector assembly in accordance with an exemplary embodiment showing the latch in a latched position.
Figure 8:
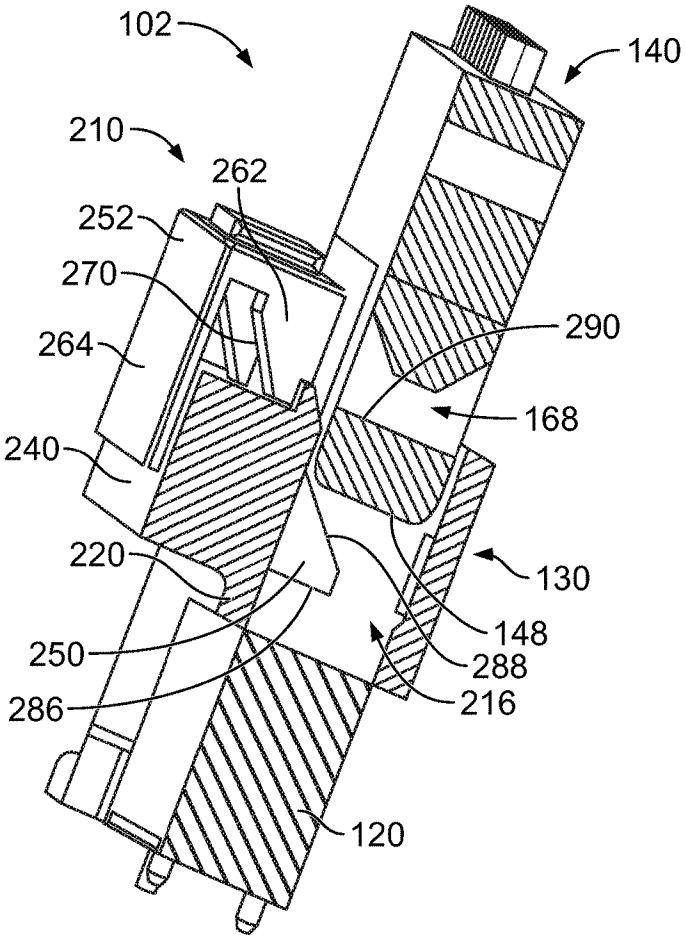
FIG. 8 is a sectional view of the card edge connector assembly showing the pluggable module being loaded into the card guide module in accordance with an exemplary embodiment.
Figure 7:
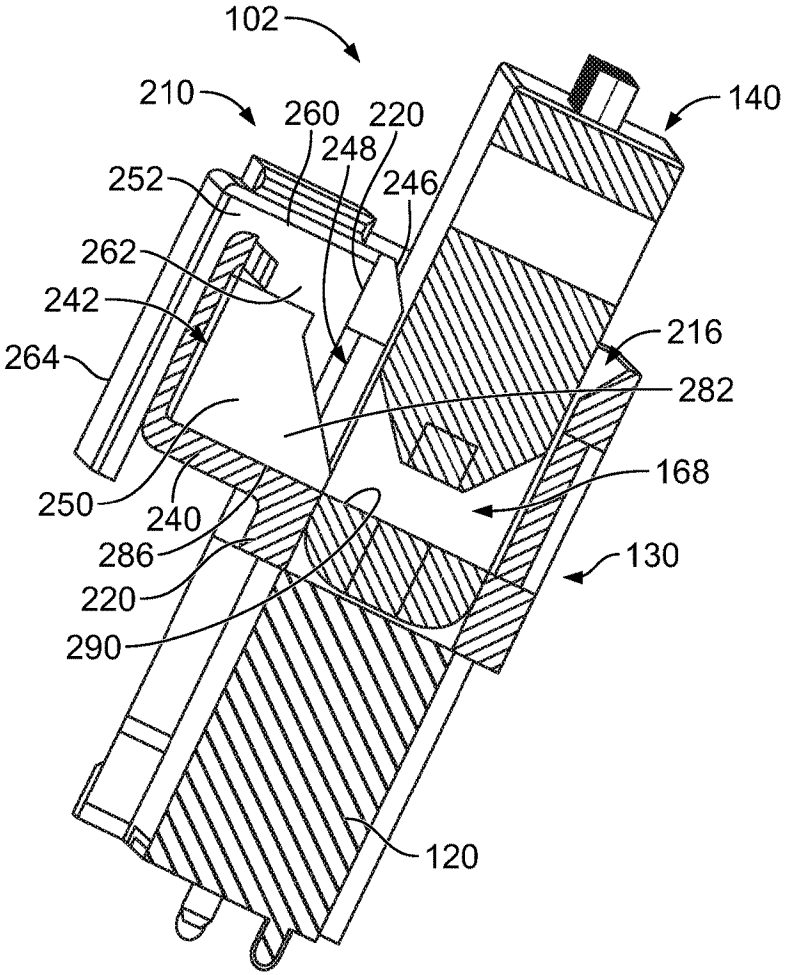
FIG. 7 is a sectional view of the card edge connector assembly showing the latch in an unlatched position.

FIG. 6 is a sectional view of the card edge connector assembly 102 in accordance with an exemplary embodiment showing the latch 210 in a latched position. FIG. 7 is a sectional view of the card edge connector assembly 102 showing the latch 210 in an unlatched position. FIG. 8 is a sectional view of the card edge connector assembly 102 showing the pluggable module 140 being loaded into the card guide module 130 in accordance with an exemplary embodiment.

When assembled, the latching member 250 is received in the latch pocket 242 of the latch frame 240. The latching member 250 is able to slide horizontally within the latch pocket 242 between the latched position and the unlatched position. The latching fingers 282 are aligned with and at least partially received in the corresponding slots 248 in the wall 246 at the first side 220. The actuator 252 is operably coupled to the latching member 250. The actuator 252 is coupled to the wall 246 at the first side 220. For example, the rails 272 on the actuator arms 262 are received in corresponding tracks 244 at the first side 220. The actuator arms 262 are received in the latch pocket 242. The main body 260 is located above the latch frame 240. The outer wall 264 is positioned forward of the latch frame 240. A portion of the latch frame 240 is received between the outer wall 264 and the actuator arms 262. The outer wall 264 and the rails 272 may guide movement of the actuator 252 during actuation. For example, the outer wall 264 and the rails 272 may restrict movement of the actuator 252 to vertical sliding relative to the latch frame 240.

In the latched position (FIG. 6), the latching member 250 is latchably secured to the pluggable module 140. For example, the latching fingers 282 extend into the cavity 216 to engage the pluggable module 140. The latching fingers 282 extend through corresponding slots 248 and are received in corresponding latching features 168 (for example, openings) in the pluggable module 140. The latching surfaces 286 engage corresponding latching surfaces 290 in the pluggable module 140 to block removal of the pluggable module 140 from the card edge connector 130. In an exemplary embodiment, the return springs 284 are spring biased against the latch frame 240 to hold the latching member 250 in the latched position. The return springs 284 press the front plate 280 and the latching fingers 282 rearward to the latched position.

In the unlatched position (FIG. 7), the latching member 250 is moved forward by the actuator 252 to the unlatched position. For example, the actuator 252 is pressed downward in an actuation direction to drive the latching member 250 forward in an unlatching direction. The ramp surfaces 270 of the actuator arms 262 engage the front plate 280 to drive the front plate 280 forward against the spring force of the return springs 284. The latching fingers 282 are at least partially removed from the cavity 216 to provide clearance from the pluggable module 140 to allow the pluggable module 140 to be removed from the cavity 216. The latching surfaces 286 no longer block the pluggable module 140 from being pulled upward and out of the card guide module 130.

Prior to loading of the pluggable module 140 into the card guide module 130, the latching member 250 is pushed rearward to a resting position (FIG. 8, which may be the same as the latched position). The latching fingers 282 extend into the cavity 216 in the area configured to receive the pluggable module 140. As the pluggable module 140 is loaded into the cavity 216, the mating end 148 of the pluggable module 140 may engage the ramp surfaces 288 of the latching fingers 282. As the pluggable module 140 is pressed downward into the cavity 216, the pluggable module 140 may be driven down the ramp surfaces 288, causing the latching member 250 to move forward to a clearance position allowing the pluggable module 140 to be fully mated with the card guide module 130 and the card edge connector 120. Once fully mated, the latching features 168 are aligned with the latching fingers 282 and the latching fingers 282 are able to move rearward into the latching features 168, allowing the latching member 250 to move to the latched position (FIG. 6).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a card edge connector having a housing defining a card slot configured to receive a pluggable module in a mating direction, the housing holding contacts in the card slot to electrically connect to the pluggable module, the contacts being configured to be electrically connected to a host circuit board;

a card guide module having a main body having a cavity configured to receive the pluggable module, the card guide module having support beams extending from the main body configured to be secured to the host circuit board, the card guide module having a window defined between the support beams under the main body receiving the card edge connector; and a latch coupled to the main body movable between a latched position and an unlatched position, the latch including a latching member and an actuator operably coupled to the latching member, the latch latchably coupled to the pluggable module in the latched position to secure the pluggable module in the cavity, the latch being decoupled from the pluggable module in the unlatched position to allow the pluggable module to be removed from the cavity.

2. The card edge connector assembly of claim 1, wherein the latching member is movable in a latching direction between the latched position and the unlatched position, the actuator being actuated in an actuation direction perpendicular to the latching direction.

3. The card edge connector assembly of claim 1, wherein the actuator includes a ramp surface engaging the latching member to drive the latching member from the latched position to the unlatched position.

4. The card edge connector assembly of claim 1, wherein the actuator is slidable along the main body in a vertical actuation direction, the latching member being slidable in a horizontal latching direction.

5. The card edge connector assembly of claim 1, wherein the latching member includes a latching finger extending through a wall of the main body into the cavity to engage the pluggable module in the latched position.

6. The card edge connector assembly of claim 1, wherein the latch includes a latching finger movable in a latching direction perpendicular to a loading direction of the pluggable module into the cavity.

7. The card edge connector assembly of claim 1, wherein the support beams include locating surfaces engaging the housing of the card edge connector to locate the card guide module with respect to the card edge connector.

8. The card edge connector assembly of claim 1, wherein the card guide module includes a guide surface in the cavity to locate the pluggable module in the cavity.

9. The card edge connector assembly of claim 1, wherein the main body includes a first side and a second side, the main body includes a first end and a second end between the first and second sides with the first and second sides being wider than the first and second ends, the main body includes a top between the first and second sides and between the first and second ends having a top opening to the cavity for receiving the pluggable module, and the main body includes a bottom between the first and second sides and between the first and second ends having a bottom opening to the window for loading the pluggable module into the card edge connector, the latch being coupled to the first side of the main body.

10. The card edge connector assembly of claim 9, wherein the main body includes a latch frame extending from the first side defining a latch pocket, the latch being received in the latch pocket, the latch having a latching finger extending through a slot in the first side of the main body to engage the pluggable module in the cavity in the latched position.

11. The card edge connector assembly of claim 1, wherein the latch includes a return spring being spring biased against the main body to force the latch to return to the latched position.

12. The card edge connector assembly of claim 1, wherein the main body includes a track, the latch including a rail received in the track to guide actuation of the latch.

13. The card edge connector assembly of claim 1, wherein the latch includes a latching finger having a ramp surface configured to engage the pluggable module when the pluggable module is loaded into the cavity to force the latch to the unlatched position as the pluggable module is loaded into the cavity.

14. A card edge connector assembly comprising:

a card edge connector having a housing defining a card slot configured to receive a pluggable module in a mating direction, the housing holding contacts in the card slot to electrically connect to the pluggable module, the contacts being configured to be electrically connected to a host circuit board;

a card guide module having a main body having a cavity configured to receive the pluggable module, the card guide module having support beams extending from the main body configured to be secured to the host circuit board, wherein the support beams support the main body independent of the card edge connector on the host circuit board, the card guide module having a window defined between the support beams under the main body receiving the card edge connector; and a latch coupled to the main body movable between a latched position and an unlatched position, the latch latchably coupled to the pluggable module in the latched position to secure the pluggable module in the cavity, the latch being decoupled from the pluggable module in the unlatched position to allow the pluggable module to be removed from the cavity.

15. The card edge connector assembly of claim 14, wherein the latch includes a latching member and an actuator operably coupled to the latching member.

16. A card edge connector assembly comprising:

a card guide module having a main body, the main body including a first side and a second side, the main body including a first end and a second end between the first side and the second side with the first and second sides being wider than the first and second ends, the main body including a top and a bottom between the first and second sides and between the first and second ends, the main body having a cavity open at the top and at the bottom for receiving a pluggable module, the card guide module having support beams extending from the main body at the first and second ends configured to be secured to a host circuit board proximate to a card edge connector, the card guide module having a window defined between the support beams below the bottom of the main body receiving the card edge connector with the card edge connector aligned with the cavity to receive the pluggable module; and a latch coupled to the first side of the main body, the latch being movable between a latched position and an unlatched position, the latch being configured to be latchably coupled to the pluggable module in the latched position to secure the pluggable module in the cavity, the latch being configured to be decoupled from the pluggable module in the unlatched position to allow the pluggable module to be removed from the cavity.

17. The card edge connector assembly of claim 16, wherein the latch includes a latching member and an actuator operably coupled to the latching member, the latching member is movable in a latching direction between the latched position and the unlatched position, the actuator being actuated in an actuation direction perpendicular to the latching direction.

18. The card edge connector assembly of claim 16, wherein the latch includes a latching finger extending through a wall of the main body into the cavity to engage the pluggable module in the latched position.

19. The card edge connector assembly of claim 16, wherein the main body includes a latch frame extending from the first side defining a latch pocket, the latch being received in the latch pocket, the latch having a latching finger extending through a slot in the first side of the main body to engage the pluggable module in the cavity in the latched position.

20. A card edge connector assembly comprising:

a card guide module having a main body, the main body including a first side and a second side, the main body including a first end and a second end between the first side and the second side, the main body including a top and a bottom between the first and second sides and between the first and second ends, the main body having a cavity open at the top and at the bottom for receiving a pluggable module, the card guide module having support beams extending from the main body at the first and second ends configured to be secured to a host circuit board proximate to a card edge connector, the card guide module having a window defined between the support beams below the bottom of the main body receiving the card edge connector with the card edge connector aligned with the cavity to receive the pluggable module, the card guide module including a latch frame extending from the first side having a latch pocket; and a latch receiving in the latch pocket of the latch frame at the first side of the main body, the latch having a latching member being movable between a latched position and an unlatched position and an actuator being movable between an actuated position and a released position, the actuator moving the latching member from the latched position to the unlatched position as the actuator is moved from the released position to the actuated position, the latching member having a latching finger passing through the first side of the main body into the cavity to latchably engage the pluggable module in the latched position to secure the pluggable module in the cavity, the latching finger being at least partially removed from the cavity to disengage from the pluggable module in the unlatched position to allow the pluggable module to be removed from the cavity.

* * * * *